US009151547B2

(12) United States Patent
Nitta et al.

(10) Patent No.: US 9,151,547 B2
(45) Date of Patent: Oct. 6, 2015

(54) HEAT EXCHANGER UTILIZING CHAMBERS WITH SUB-CHAMBERS HAVING RESPECTIVE MEDIUM DIRECTING INSERTS COUPLED THEREIN

(71) Applicant: MiKuTAY Corporation, Upland, CA (US)

(72) Inventors: Minoru Nitta, Upland, CA (US); Takeyoshi Nitta, Upland, CA (US)

(73) Assignee: MIKUTAY CORPORATION, Upland, CA (US)

( * ) Notice: Subject to any disclaimer, the term of this patent is extended or adjusted under 35 U.S.C. 154(b) by 258 days.

(21) Appl. No.: 13/948,889

(22) Filed: Jul. 23, 2013

(65) Prior Publication Data

US 2015/0027675 A1 Jan. 29, 2015

(51) Int. Cl.

| | |
|---|---|
| ***F28F 13/12*** | (2006.01) |
| ***F28F 9/00*** | (2006.01) |
| ***F28F 9/22*** | (2006.01) |
| ***F28F 13/08*** | (2006.01) |

(52) U.S. Cl.

CPC ... *F28F 9/00* (2013.01); *F28F 9/22* (2013.01); *F28F 13/08* (2013.01)

(58) Field of Classification Search

CPC ..... Y10S 165/439; F28F 1/10; F28F 1/006; F28F 13/12; F28F 3/086; F28F 9/22; F28F 9/222; F28F 9/226; F28F 9/228; F28F 13/08; F28D 9/0043; F28D 9/0012

USPC ..... 165/109.1, 144

See application file for complete search history.

(56) References Cited

U.S. PATENT DOCUMENTS

| | | | |
|---|---|---|---|
| 141,133 | A | 7/1873 | Gee |
| 265,279 | A | 10/1882 | Pierce et al. |

(Continued)

FOREIGN PATENT DOCUMENTS

| | | | |
|---|---|---|---|
| DE | 2249117 | A1 | 4/1974 |
| DE | 3300929 | A1 | 7/1984 |

(Continued)

OTHER PUBLICATIONS

Patent Office of the Russian Federation, "Decision on Grant, A Patent for Invention, Report on Results of Examination" re: Patent Application Serial No. 2010147367/06(068438); Date: Jul. 17, 2012, 20 pages.

(Continued)

*Primary Examiner* — Tho V Duong

(57) ABSTRACT

A heat exchanging device has a main chamber, two sub-chambers, an inlet and an outlet. The sub-chambers extend outwardly from both planar walls of the main chamber. Disposed within main chamber and the sub-chambers is a medium directing insert. The insert has an angled surface on ends facing the inlet and the outlet, first directing the flow of the heat exchange medium into the main chamber, so that the heat exchange medium is dispersed within the main chamber, then directing the heat exchange medium out of the device through the outlet. The medium directing insert is bonded to the lateral walls of the sub-chambers to enhance the structural integrity of the device. The lateral walls of the medium directing insert cooperate with the planar and lateral walls of the main chamber to form channels for directing flow of the heat exchange medium within the device.

20 Claims, 3 Drawing Sheets

(56) References Cited

U.S. PATENT DOCUMENTS

| | | | | |
|---|---|---|---|---|
| 709,006 | A | 9/1902 | Geurink | |
| 1,327,165 | A * | 1/1920 | Merritt | 165/148 |
| 1,336,225 | A | 4/1920 | Hardie | |
| 1,656,790 | A * | 1/1928 | Heijkenskjold | 165/90 |
| 1,666,660 | A | 4/1928 | Makin | |
| 1,714,771 | A | 5/1929 | Fuchs | |
| 1,844,308 | A | 2/1932 | Armacost | |
| 2,030,734 | A | 2/1936 | Baird | |
| 2,274,965 | A | 3/1942 | Kitto | |
| 2,752,127 | A | 6/1956 | Campe et al. | |
| 3,099,315 | A | 7/1963 | Loehr | |
| 3,759,322 | A | 9/1973 | Nasser et al. | |
| 3,923,383 | A | 12/1975 | Engel et al. | |
| 3,976,128 | A | 8/1976 | Patel | |
| 4,332,293 | A | 6/1982 | Hiramatsu | |
| 4,871,017 | A | 10/1989 | Cesaroni | |
| 4,955,435 | A | 9/1990 | Shuster et al. | |
| 4,981,170 | A * | 1/1991 | Dierbeck | 165/109.1 |
| 5,137,080 | A | 8/1992 | Haasch et al. | |
| 5,211,222 | A | 5/1993 | Shinmura | |
| 1,946,234 | A | 2/1994 | Price | |
| 5,505,252 | A * | 4/1996 | Mano | 165/109.1 |
| 5,538,077 | A | 7/1996 | So et al. | |
| 6,612,031 | B2 | 9/2003 | Rhodes | |
| 7,987,900 | B2 | 8/2011 | Nitta et al. | |
| 8,307,886 | B2 | 11/2012 | Nitta et al. | |
| 8,393,385 | B2 | 3/2013 | Nitta et al. | |
| 8,584,741 | B2 | 11/2013 | Nitta et al. | |
| 2004/0079516 | A1 | 4/2004 | Leeson et al. | |
| 2006/0278368 | A1 | 12/2006 | Dawson | |
| 2007/0215330 | A1 | 9/2007 | Umetsu | |
| 2009/0260786 | A1 | 10/2009 | Palanchon | |
| 2010/0046934 | A1 | 2/2010 | Johnson et al. | |
| 2010/0224346 | A1 * | 9/2010 | Rasmussen | 165/109.1 |
| 2011/0030936 | A1 | 2/2011 | Nitta et al. | |
| 2013/0098590 | A1 | 4/2013 | Nitta et al. | |
| 2014/0131022 | A1 | 5/2014 | Nitta et al. | |

FOREIGN PATENT DOCUMENTS

| | | | |
|---|---|---|---|
| EP | 1824629 | B1 | 5/2011 |
| FR | 2898405 | A1 | 9/2007 |
| JP | S50-11257 | | 4/1975 |
| JP | S56-068795 | | 6/1981 |
| JP | 56154275 | | 11/1981 |
| JP | S58-154393 | | 10/1983 |
| JP | H10-306995 | A | 11/1998 |
| JP | 1128571 | A | 10/1999 |
| JP | 2006-336902 | A | 12/2006 |
| RU | SU1814716 | A3 | 5/1993 |
| WO | WO 03/056267 | A1 | 7/2003 |
| WO | WO 2008/139651 | A1 | 11/2008 |

OTHER PUBLICATIONS

Korean Intellectual Property Office, "Notice of Preliminary Rejection" re: Patent Application Serial No. 10-2010-7025911, Date: Jun. 1, 2012, 7 pages.

Japanese Patent Office, "Notification of Reasons for Rejection" re: Patent Application Serial No. 2011-506261, Drafting Date: May 24, 2012, 6 pages.

State Intellectual Property Office of the People'S Republic of China, "Notice of Second Office Action" Patent Application No. 200980114176.7 of Mikutay Corporation; Issue Date: Aug. 16, 2012; 60 pages.

State Intellectual Property Office of the People'S Republic of China, "Notice of Third Office Action" Patent Application No. 200980114176.7 of Mikutay Corporation; Issue Date: Jan. 29, 2013; 62 pages.

State Intellectual Property Office of the People'S Republic of China, "Notice of Fourth Office Action" Patent Application No. 200980114176.7 of Mikutay Corporation; Issue Date: Nov. 12, 2013; 65 pages.

English translation of publication DE 3300929 Al published on Jul. 19, 1984; 16 pages.

Patent Cooperation Treaty, "International Search Report and Written Opinion of the International Searching Authority" International Application No. PCT/US2013/065070 of Mikutay Corporation; Mailing Date: Mar. 6, 2014; 11 pages.

* cited by examiner

HEAT EXCHANGER UTILIZING CHAMBERS WITH SUB-CHAMBERS HAVING RESPECTIVE MEDIUM DIRECTING INSERTS COUPLED THEREIN

BACKGROUND OF THE INVENTION

1. Field of the Invention

The present invention relates generally to tube and chamber heat exchangers, and more specifically, to a tube and chamber heat exchanger having main chambers with sub-chambers. The sub-chambers extend outwardly from both planar walls of the main chamber, with the chambers and sub-chambers containing a medium directing insert, which directs the heat exchange medium entering and exiting the main chamber.

2. Discussion of the Related Art

Heat exchangers are commonly utilized in applications where heat is desired to be added or removed. Typical basic heat exchangers are made of generally straight pipes, which channel a heat exchanging medium within, and have a second heat exchange medium flowing on an outer surface of the heat exchanger. Commonly, straight pipes are enhanced with mechanically formed indentations on the outer surface of the straight pipes as well as in some applications on an inner surface of the straight pipes to improve heat exchange performance. Additional plate materials may also be added to the straight pipes' inner surfaces as well as outer surfaces to increase the surface area, which typically improves heat exchanger performance. Headers or manifolds may be attached to each end of the pipes. These headers and manifolds act as receptacles for the heat exchanging medium. Heat exchanging performance of the heat exchanger is limited by the amount of surface area available for the transfer of heat.

To increase surface area to enhance heat exchange performance, typical heat exchangers, such as condensers, incorporate a flat-tube design, usually of extruded tubular material with extended surfaces provided by a corrugated fin material. The corrugated fin material is generally interposed between a pair of extruded tubular materials. This type of a heat exchanger typically includes flattened tubes having a fluid passing therethrough and a plurality of corrugated fins extending between the tubes. The fins are attached to the tubes to increase the surface area of the tubes, thereby enhancing the heat transfer capability of the tubes. A number of tubes and fins may be stacked on top of each other, with a small opening to allow passage of air therethrough. To further improve heat transfer efficiency, the tube's wall thickness may be made thinner. As a result, the parts are lighter in weight, which in turn makes the overall heat exchanger lighter in weight. However, the pressure resistance is reduced, and the thinner tubes are more prone to damage. Also, the assembly process is complicated due to the fragile nature of the parts. In addition, extruded tubes are prone to plugging during the manufacturing process, particularly if a brazing process is utilized. Complexity of the extruding process potentially results in higher costs and higher defect rates. Furthermore, as flat tubes are generally extruded into shape utilizing metal extrusion processes, only material that can be easily extruded into shape is typically made into flat tubes, restricting the material available for flat tubes generally to aluminum and various aluminum alloys.

The overall cost for the flat tube heat exchanging system is higher because a large compressor is necessary to circulate the heat exchanging medium through the small openings of the tubes. Conversely, if a higher powered compressor is not utilized, then additional tubes are necessary to obtain the desired heat exchanging performance, as the smaller tubes reduce flow of the heat exchange medium significantly. The addition of tubes increases the overall cost for the heat exchanging system. Currently, this type of a heat exchanger is used in applications requiring high heat exchanging capabilities, such as automotive air conditioner condensers.

In another tube-and-fin design, the tube can be of a serpentine design, therefore eliminating the need for headers or manifolds, as the tube is bent back and forth in an "S" shape to create a similar effect. Typical applications of this type of a heat exchanger, besides condensers, are evaporators, oil coolers, and heater cores. The serpentine design is essentially a single long tube which transfers the heat exchange medium from the inlet of the serpentine design heat exchanger to the outlet. As a result, the pressure resistance to the heat exchange medium travelling through the heat exchanger is high, which is detrimental to the performance of the heat exchanger. In an application such as an evaporator, wherein pressure drop is unfavorable to the overall performance of a refrigeration cycle, the serpentine design is especially ill suited.

A variation on tube-based heat exchangers involves stacking flat ribbed plates. When stacked upon each other, these ribbed plates create chambers for transferring heat exchanging medium. In essence, this type of a heat exchanger performs in substantially the same manner as tube-and-fin type heat exchangers, but is fabricated differently. This type of a heat exchanger is commonly implemented in contemporary evaporators.

Another variation of a heat exchanger is a tube and chamber design with a medium directing member inserted within the chamber (see, e.g. U.S. Pat. Nos. 7,987,900, 8,393,385, and 8,307,886). The tube and chamber design heat exchanger functions by having a chamber section combined with a medium directing member, wherein heat exchange medium is forced to travel in a turbulent flow. As a heat exchange medium enters the heat exchanger chamber, the heat exchange medium flows in a straight line through a straight tube section. At the end of the straight tube section is a medium directing member which is disposed within the chamber assembly. The medium directing member alters the direction of the heat exchange medium flow from the generally straight line flow to almost a perpendicular flow, while leading the heat exchange medium into the chamber section of the heat exchanger. The chamber section is connected to the tube section, and the chamber section is generally of a larger diameter than the tube section. As the heat exchange medium is introduced into the chamber section, heat exchange medium flows in at least one semi-circular path within the chamber section. As the heat exchange medium completes the semi-circular flow within the chamber section, the heat exchange medium once again comes to contact with the medium directing member. As the heat exchange medium comes to contact with the medium directing member, flow of the heat exchange medium is restored into a generally straight flow in the original flow direction, and the heat exchange medium is led to yet another tube section of the heat exchanger. This process repeats itself within the length of the tube and chamber design heat exchanger.

In a typical tube and chamber heat exchanger assembly, the medium directing member is simply inserted into the chamber assembly. In such an embodiment, the medium directing member does not contribute significantly to the structural rigidity of the heat exchanger, and the chamber assembly and the medium directing member may be coupled together by a limited amount of contact area. In such an embodiment, a suitable application for such a heat exchanger may be restricted to low to moderate internal pressure application usage.

A typical tube and chamber heat exchanger comprises of a plurality of chamber and tube assemblies, with a medium directing member inserted inside each chamber assembly. In this embodiment of a heat exchanger, the manufacturing process may be somewhat complicated as individual medium directing members must be placed within the chamber assembly during an assembly process, without having a locating mechanism to position the medium directing member within the chamber assembly. In such an embodiment, the medium directing member may become dislodged or misaligned during the manufacturing process, thereby decreasing the efficiency of the heat exchanger.

SUMMARY OF THE INVENTION

The present invention is an enhanced tube and chamber heat exchanger having a chamber assembly, the chamber assembly having a main chamber section and sub-chamber sections. The main chamber has a first planar wall, a second planar wall, and a lateral wall connecting generally the outer circumference of the first planar wall and the second planar wall. The first planar wall and the second planar wall are generally parallel to each other, and are set apart at a predetermined distance to allow a gap between each other. The lateral wall connects the outer circumference of the first planar wall and the second planar wall, forming a watertight seal. The main chamber is hollow, allowing flow of a heat exchange medium within. On the first planar wall and the second planar wall of the main chamber, sub-chambers extend outwardly away from the main chamber. Each sub-chamber is generally cylindrical in shape, and the diameter is generally smaller than the diameter of the main chamber. Each sub-chamber includes a lateral wall extending outwardly from the first and the second planar walls of the main chamber. The lateral wall of each sub-chamber terminates on a respective planar wall, the sub-chamber planar walls being generally parallel to the first and the second planar walls of the main chamber. The planar walls of the sub-chamber are set apart from the planar walls of the main chamber at a predetermined distance, forming a cylindrical chamber on the first and the second planar walls of the main chamber. The sub-chambers and the main chamber are in a fluid communication, allowing flow of a heat exchange medium between the main chamber and the sub-chambers. On the outer planar wall of the first sub-chamber is an inlet, allowing flow of a heat exchange medium into the first sub-chamber. On the outer planar wall of the second sub-chamber is an outlet, allowing discharge of the heat exchange medium out of the second sub-chamber.

Contained within the first and the second sub-chamber is a medium directing insert. The exterior of the medium directing insert is generally contoured to the shape of the inner circumference of the first sub-chamber and the second sub-chamber. The medium directing insert is at least partially bonded to the inner surface of the lateral wall of the first sub-chamber, extends laterally through the main chamber, and is at least partially bonded to the inner surface of the lateral wall of the second sub-chamber. The inlet on the first sub-chamber is coupled to a tube structure. The outlet on the second sub-chamber is coupled to another tube structure. The tube structures are hollow to permit flow of the heat exchange medium within. Plural sets of tube and chamber assemblies are arranged to form a heat exchanger. First ends of plural sets of tube and chamber assemblies may attach to a manifold or a header. Second ends of plural sets of tube and chamber assemblies may also attach to a manifold or a header.

The heat exchange medium first flows in an initial line of flow within the tubular structure. The end of a tubular structure is attached to the inlet on the first sub-chamber. As the heat exchange medium enters the inlet, the heat exchange medium is introduced into the interior of the first sub-chamber and comes into contact with the first side of the medium directing insert. The first side of the medium directing insert facing the inlet is set at an angle to direct the heat exchange medium to a second line of flow, wherein the second line of flow is generally perpendicular to the initial line of flow. As the heat exchange medium is directed into the second line of flow, the heat exchange medium is directed into the interior of the main chamber. After the heat exchange medium enters the main chamber, the heat exchange medium flows in two semi-circular flow paths within the main chamber. The heat exchange medium flows within the main chamber, following a channel formed by the interior surface of the lateral wall of the main chamber, the exterior surface of the medium directing insert, and the first and second planar walls of the main chamber. After the heat exchange medium completes the semi-circular flow within the main chamber, the heat exchange medium comes into contact with the second side of the medium directing insert. The second side of the medium directing insert is set at an angle facing the outlet on the second sub-chamber. The second side of the medium directing insert may be formed on the same piece of the material which provides the first side of the medium directing insert. Generally, the angled first surface of the medium directing insert and the angled second surface of the medium directing insert are set parallel to each other. As the heat exchange medium encounters the angled second surface of the medium directing insert, the flow of the heat exchange medium is generally restored to that of the initial line of flow. The heat exchange medium flows through the second sub-chamber, and discharges to the tube structure attached to the outlet of the sub-chamber. The main chamber, sub-chambers and a medium directing insert, form a chamber assembly. Plural sets of chamber assemblies interconnected by tube structures form a heat exchanger assembly. The flow pattern is repeated throughout the plural sets of main chambers, sub-chambers, medium directing inserts, and tube structures in a heat exchanger assembly.

In another embodiment of the present invention, a first chamber assembly may connect directly to a second chamber assembly instead being connected by tube structures. In yet another embodiment of the present invention, a first chamber assembly may connect directly to a second chamber assembly by use of a tubular insert connecting the outlet of the first chamber assembly to the inlet of the second chamber assembly. The tubular insert forms a watertight seal between the first chamber assembly and the second chamber assembly. Such tubular insert may not be visible from the exterior of the chamber assembly.

As the heat exchange medium flows through the plurality of chamber assemblies, heat contained within the heat exchange medium is absorbed by the material comprising the chamber assemblies. Heat absorbed by the chamber assemblies is then released to the environment external to the assemblies.

In an embodiment of the present invention, a heat exchange medium flows from a first manifold through an interconnecting tube to the inlet of a chamber assembly. The heat exchange medium may flow through a plurality of chamber assemblies. The heat exchange medium is discharged through the outlet of the last chamber assembly into a second manifold through an interconnecting tube.

An advantage of the present invention is that the heat exchanger has a larger surface area for radiating heat over a shorter distance than that of a conventional heat exchanger, with the surface area provided by the tube structures, main chamber assemblies, and sub-chamber assemblies. With the provision of a large surface area for heat exchanging purposes, the efficiency of the heat exchanger is greatly increased. This provides for a lower overall cost as less raw materials and packaging are used.

Structural rigidity is provided by having the medium directing insert being bonded to the first sub-chamber and the second sub-chamber of the chamber assembly. This lends use of the heat exchanger in applications requiring high internal or external pressure environments. Structural rigidity may be provided by utilizing cladded material in combination with a brazing technology, thereby bonding all components together to form a unitary unit. Additionally, welding or soldering of individual components is used in certain applications. In some application, the medium directing insert may be bonded to the sub-chambers by an adhesive.

Another advantage of the present invention over a conventional heat exchanger is that the manufacturing process may be simpler because the present invention requires less fragile components and less manufacturing processes. The present invention provides an easy to assemble heat exchanger with enhanced heat exchanging performance while being cost effective. The present invention also excels in high pressure applications typical in commercial and industrial applications, by having the medium directing insert bonded to the inner surface of the first sub-chamber and the second sub-chamber. The entire unit may be brazed together, or any portion of the unit can be brazed first, and then additional components may be brazed, soldered together, or attached by mechanical means, with or without utilization of gaskets. The present invention also lends itself for ease of assembly by having the sub-chambers function as a locating mechanism for the medium directing inserts, when the chamber assemblies are assembled.

Other features and advantages of the present invention will be appreciated, as the same becomes better understood after reading the subsequent description taken in conjunction with the accompanying drawings.

DETAILED DESCRIPTION

Figure 1A:
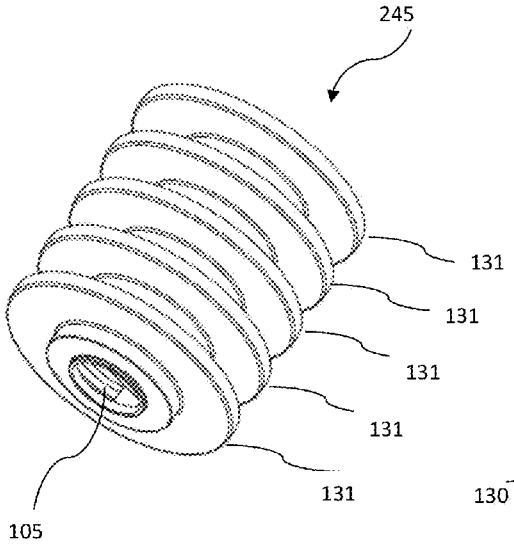
FIG. 1A is a perspective view of a heat exchanger assembly having a plurality of chamber assemblies according to an embodiment of the present invention.
Figure 1B:
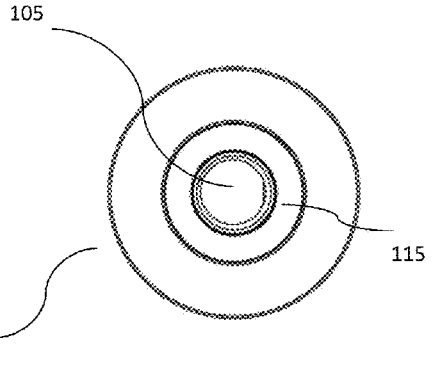
FIG. 1B is a top view of a chamber assembly according to an embodiment of the present invention.
Figure 1C:
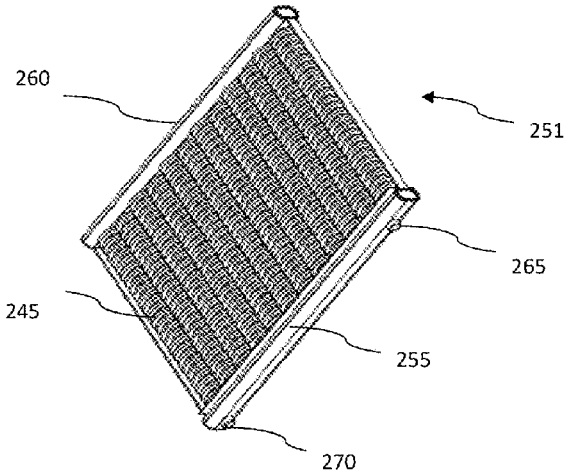
FIG. 1C is a perspective view of a heat exchanger unit having a plurality of heat exchanger assemblies according to an embodiment of the present invention.
Figure 1D:
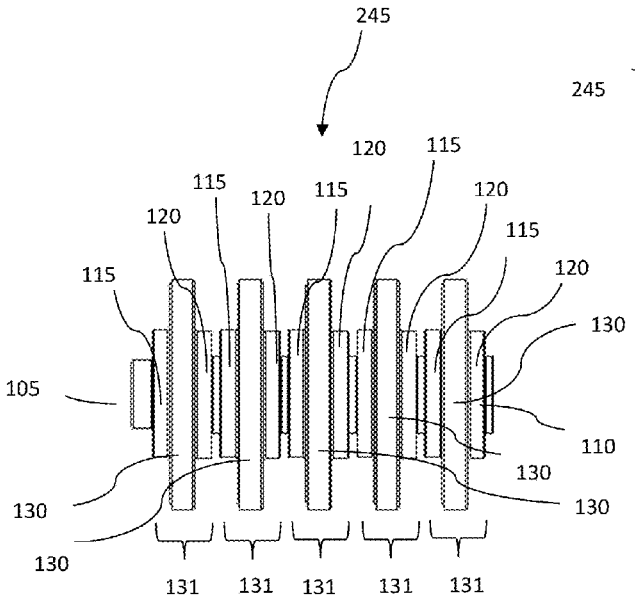
FIG. 1D is a side view of a heat exchange assembly.

Referring to the drawings and in particular to FIG. 1A and FIG. 1D, an embodiment of a heat exchanger assembly 245 is shown. The heat exchanger assembly 245 includes a plurality of chamber assemblies 131. Each chamber assembly 131 includes a main chamber 130, a first sub-chamber 115 and a second sub-chamber 120. For a given chamber assembly, the main chamber 130, the first sub-chamber 115, and the second sub-chamber 120 are interconnected to each other, forming a watertight vessel. The heat exchange assembly 245 has an inlet 105 to introduce heat exchange medium into the heat exchange assembly 245, and an outlet 110 to allow the heat exchange medium to flow out of the heat exchange assembly 245. In FIG. 1B, a top view of the chamber assembly is shown. The sub-chamber 115 (and sub-chamber 120) are generally of a smaller dimension than the main chamber 130.

Referring to FIG. 1C, a heat exchanger unit 251 is formed from a plurality of heat exchange assemblies 245. As shown, the heat exchange assemblies may be arranged in a plurality of rows between a first manifold 255 and a second manifold 260. The heat exchanger unit 251 has an inlet 265 to introduce a heat exchange medium into the heat exchanger unit 251, and an outlet 270 to allow the heat exchange medium to exit the heat exchanger unit 251. The flow pattern may be a simple single directional flow from the first manifold 255 to the second manifold 260. Alternatively, the manifolds 255 and 260 may feature baffles within the structures, allowing for more complex multiple flow patterns, wherein multiple flow patterns exist between the first manifold 255 and the second manifold 260. In an embodiment of the present invention, the heat exchanger unit 251 generally features two heat exchange media, one heat exchange medium flowing inside of the heat exchanger unit 251, and a second heat exchange medium flowing outside of the heat exchanger unit 251, wherein heat transfers from one heat exchange medium to the other. The heat exchange medium utilized within the heat exchanger unit 251 may be the same as the heat exchange medium utilized on the outside of the heat exchanger unit 251. The heat exchange medium utilized within the heat exchanger unit may also differ from the heat exchange medium utilized on the outside of the heat exchanger unit. The inlet 265 and the outlet 270 may be installed on the same manifold 255 or installed on different manifolds at opposite sides of the heat exchanger unit 251.

Figure 2A:
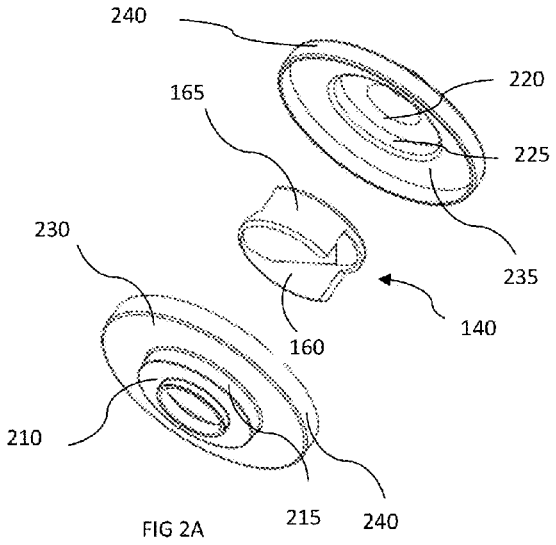
FIG. 2A is an exploded view of a chamber assembly having a medium directing insert.
Figure 2B:
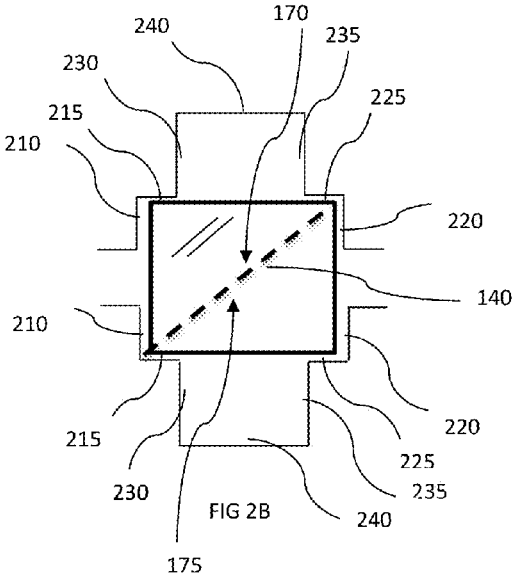
FIG. 2B is a schematic view of a chamber assembly showing the main chamber and sub-chambers according to an embodiment of the present invention.

Referring to FIG. 2A, an exploded view of a chamber assembly 131 is shown. FIG. 2A also shows the positional relationship of the medium directing insert 140 relative to the main chamber 130, the first sub-chamber 115, and the second sub-chamber 120. Referring now to FIG. 2B as well as to FIG. 2A, the first sub-chamber 115 comprises a planar wall 210 and a lateral wall 215. The planar wall 210 has an opening to serve as an inlet. The lateral wall 215 is attached generally perpendicularly to the planar wall 210, on the outer periphery of the planar wall 210. The lateral wall 215 is attached to the main chamber 130, wherein the lateral wall 215 extends to terminate at a first planar wall 230 of the main chamber 130. On the outer periphery of the first planar wall 230, a lateral wall 240 attaches generally at a perpendicular angle in relationship to the first planar wall 230 of the main chamber 130. The lateral wall 240 terminates at a second planar wall 235 of the main chamber 130. The second planar wall 235 is generally parallel to the first planar wall 230. A lateral wall 225 of the second sub-chamber 120 extends perpendicularly in relation to the second planar wall 235, extending outwardly away from the second planar wall 235. The second sub-chamber lateral wall 225 terminates at a planar wall 220. The planar wall 220 is generally attached at a perpendicular angle in relation to the lateral wall 225. The planar wall 220 of the second sub-chamber has an opening to serve as an outlet.

As shown in FIG. 2A, the main chamber lateral wall 240 may be comprised of two walls. One wall has a slightly smaller circumference than the other so that the one may be fitted within the other. In other embodiments, the outer wall of the main chamber is not flat, but instead has the shape of a "U" or a "V".

Disposed within the chamber assembly is a medium directing insert 140. The medium directing insert 140 is generally of a cylindrical shape, having a first lateral wall 160 and a second lateral wall 165, forming the lateral exterior walls of the medium directing insert 140. Each of the lateral walls 160, 165 has the shape of a partial semi-circle. The lateral walls 160, 165 are dimensioned to fit under and engage with the lateral wall 215 of the first sub-chamber. The medium directing insert 140 is bonded to the chamber assembly 131 in that at least one of (and preferably each of) the walls 160, 165 of the medium directing insert 140 is bonded to the lateral wall 215 of the first sub-chamber 115. The first end edge of one or both of the two semi-circular walls 160 and 165 of the medium directing insert 140 may also be bonded to the planar wall 210 of the first sub-chamber 115. The two semi-circular lateral walls 160 and 165 extend through the main chamber 130. The wall 160 of the medium directing insert 140 is set at a distance from the lateral wall 240 of the chamber assembly 131, permitting flow of heat exchange medium between the wall 160 of the medium directing insert 140 and the lateral wall 240 of the chamber assembly 131. The wall 165 of the medium directing insert 140 is also set at a distance from the lateral wall 240 of the chamber assembly 131, permitting flow of heat exchange medium between the wall 165 of the medium directing insert 140 and the lateral wall 240 of the chamber assembly 131. The lateral walls 160, 165 are dimensioned to fit under and engage with the lateral wall 225 of the second sub-chamber. At least one of (and preferably each of) the two semi-circular walls 160 and 165 of the medium directing insert is bonded to the lateral wall 225 of the second sub-chamber 120. The second end edge of one or both of the walls 160, 165 may also be bonded to the planar wall 220 of the second sub-chamber 120.

Figure 2C:
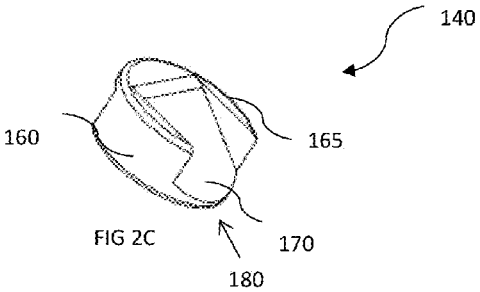
FIG. 2C is a perspective view of a medium directing insert, generally showing the top side of the insert.
Figure 2D:
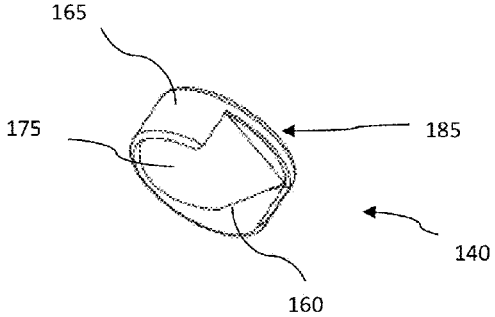
FIG. 2D is a perspective view of the medium directing insert, generally showing the bottom side of the insert.
Figure 2E:
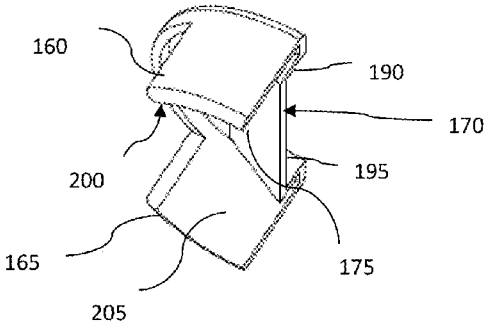
FIG. 2E is a side view of the medium directing insert.

Referring to FIG. 2C and FIG. 2E, on the first side of the medium directing insert 140 is a first channel 180. The base of the first channel 180 has a planar surface 170 set at an angle. The first channel 180 has lateral walls 190 and 195 extending away from the planar surface 170 toward the opening (inlet) in the planar wall 210 of the first sub-chamber 115. The lateral walls 190, 195 are essentially the interior sides of the lateral walls 160, 165, respectively. However, depending on the method (e.g., stamping) used to fabricate the medium directing insert, walls 160 and 190 may be spaced apart from each other. Similarly, walls 165 and 195 may be spaced apart from each other.

Referring to FIG. 2D and FIG. 2E, on the second side of the medium directing insert 140 is a second channel 185 having a planar surface 175 at the base of the channel 185. The planar surface 175 is set at an angle. In the preferred embodiment, the planar surface 170 and the planar surface 175 are opposite sides of the same portion of the medium directing insert. The second channel 185 has lateral walls 200 and 205 extending away from the planar surface 175, toward the opening (outlet) in the planar wall 220 of the second sub-chamber 120. The lateral walls 200, 205 are essentially the interior sides of the lateral walls 160, 165, respectively. However, depending on the method used to fabricate the medium directing insert, wall 200 may be separated from wall 160, and wall 205 may be separated from wall 165.

Figure 3A:
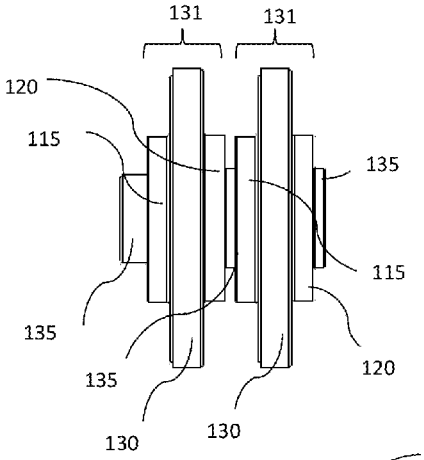
FIG. 3A is a side view of a heat exchanger assembly according to an embodiment of the present invention.

Referring to FIG. 3A, the chamber assemblies 131, each including a first sub-chamber 115, a main chamber 130 and a second sub-chamber 120, may be joined to each other by a tubular structure 135. The first tubular structure 135 of a heat exchange assembly may connect to a first manifold, while the last tubular structure 135 of a heat exchange assembly may connect to a second manifold (see FIG. 1C). In FIG. 3A, a tubular structure 135 between the two chamber assemblies 131 is visible. However, a tubular structure may fit within the inlet/outlet of a chamber assembly 131 and be of such length that it is not visible between the two chamber assemblies.

Figure 3B:
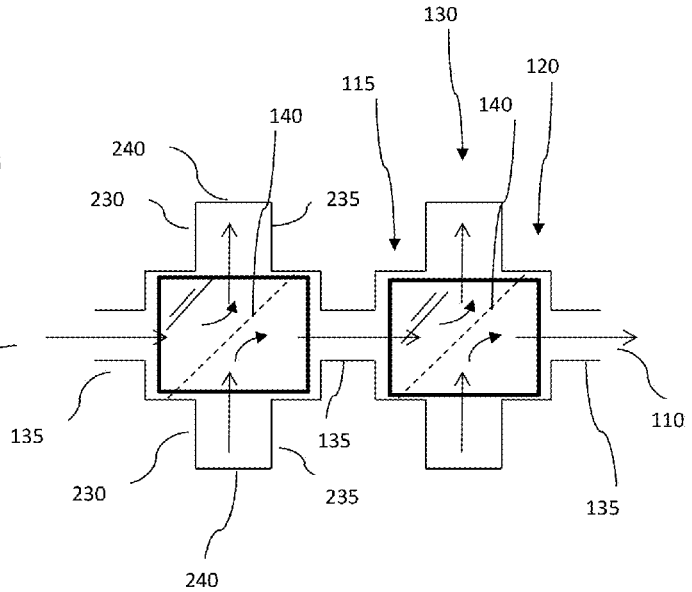
FIG. 3B is a schematic view of a heat exchanger assembly according to an embodiment of the present invention, showing an internal view of the heat exchange medium flow pattern.
Figure 3C:
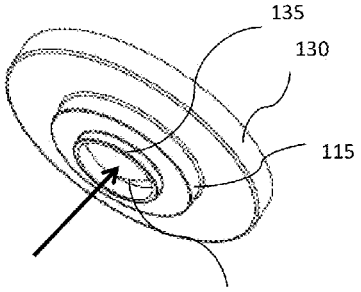
FIG. 3C is a perspective view of a chamber assembly according to an embodiment of the present invention.
Figure 3D:
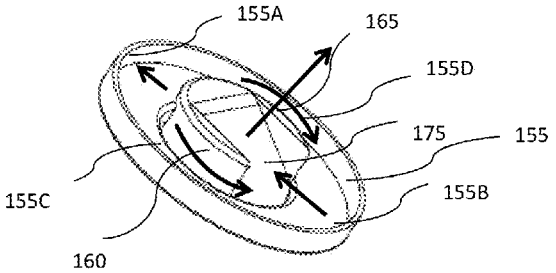
FIG. 3D is an internal view of a part of a chamber assembly according to an embodiment of the present invention, showing the flow pattern of a heat exchange medium within the chamber assembly.
Figure 3E:
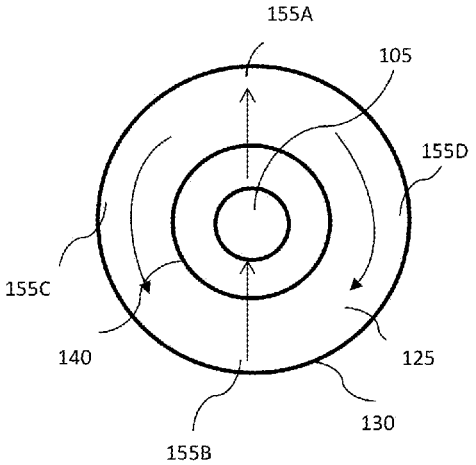
FIG. 3E is a top view of a chamber assembly according to an embodiment of the present invention, showing the heat exchange medium flow pattern within the chamber assembly.

Referring now to FIG. 3B, the heat exchange medium flow pattern within a heat exchanger assembly having two chamber assemblies is shown. The heat exchanger assembly has an inlet 105 on a tubular structure 135, whereby the heat exchange medium is introduced. As the heat exchange medium flows through the tubular structure 135, the heat exchange medium is introduced into the first sub-chamber 115. As the heat exchange medium enters the first sub-chamber 115, the heat exchange medium flows through the first channel 180 of the medium directing insert 140. Referring also to FIG. 3C, FIG. 3D and FIG. 3E, as the heat exchange medium flows through the first channel 180, the heat exchange medium comes into contact with the angled surface 170 of the medium directing insert 140. As the heat exchange medium flows through the channel 180, the heat exchange medium is directed to flow towards one section 155A of the main chamber 130. The channel 180 consists of the base surface 170 and the two lateral walls 190 and 195 of the medium directing insert. As the heat exchange medium flows towards the main chamber section 155A, the heat exchange medium is generally divided into two semi-circular flow paths, the original flow path being dispersed by the lateral wall 240 of the main chamber 130 in section 155A. The first semi-circular flow path of heat exchange medium flows through a first semi-circular channel, formed by the lateral wall 240 of the main chamber in chamber section 155C, the lateral wall 160 of the medium directing insert 140, and the two parallel planar walls of the main chamber 130, i.e., the first planar wall 230 and the second planar wall 235. The lateral wall 240 of the main chamber and the lateral wall 160 of the medium directing insert 140 are set apart at a distance in section 155C to allow flow of the heat exchange medium between the walls. The second semi-circular flow path of heat exchange medium flows through a second semi-circular channel formed by the lateral wall 240 of the main chamber in chamber section 155D, the lateral wall 165 of the medium directing insert 140, and the two parallel planar walls of the main chamber 130, i.e., the first planar wall 230 and the second planar wall 235. The lateral wall 240 of the main chamber and the lateral wall 165 of the medium directing insert 140 are also set apart at a distance in section 155D to allow flow of heat exchange medium between the two walls.

As the heat exchange medium completes the two semi-circular flow paths within the main chamber 130, the two flow paths terminate generally around the main chamber section 155B. At the main chamber section 155B, the two semi-circular flows combine together. As the two semi-circular flows combine together, the heat exchange medium flows through the second channel 185 of the medium directing insert 140, wherein the heat exchange medium encounters the second side of the medium directing insert 140. The second side of the medium directing insert 140 features the angled surface 175. As the heat exchange medium comes into contact with the angled surface 175 of the medium directing insert 140, (and the two lateral walls 200 and 205 of the medium directing insert forming the second channel 185), the heat exchange medium is directed to flow through the second sub-chamber 120. As the heat exchange medium completes the flow through the second sub-chamber 120, the heat exchange medium is directed towards the next tubular structure 135. After the heat exchange medium flows through the tubular structure 135, the heat exchange medium is led to the next chamber assembly. From the outlet 110 of the last chamber assembly, the heat exchange medium exits the heat exchanger assembly.

During the transport of the heat exchange medium through the chamber assemblies, the heat contained within the heat exchange medium is transferred to the material forming the chamber assemblies 131 and the tubular structures 135. The heat absorbed by the material is then transferred to the outside environment. Although not meant to be limiting, common heat exchange medium known in the art includes various refrigerants (e.g., R-134A, R-410A), ammonium, gases (e.g., air, carbon dioxide), water, oils, and various mixtures of chemicals.

In an embodiment of the present invention, a first heat exchange medium may flow within the heat exchanger unit 251 and a second heat exchange medium may flow on the outside of the heat exchanger unit 251. The first heat exchange medium may be various heat exchange medium known in the art, such as various refrigerants (e.g., R-134A, R-410A), ammonium, gases (e.g., air, carbon dioxide), water, oils, and various mixtures of chemicals. The second heat exchange medium may also be various refrigerants (e.g., R-134A, R-410A), ammonium, gases (e.g., air, carbon dioxide), water, oils, and various mixtures of chemicals. When more than one heat exchange medium is utilized, heat from the first heat exchange medium may be absorbed by the second heat exchange medium, or vice versa.

In FIG. 3A, the tubular structure 135 is illustrated as being hollow and circular. In other embodiments, the tubular structure 135 may be hollow but non-circular, such as an oval, rectangular shape, or other geometric shapes. In the illustrated embodiment, the main chamber 130 is hollow and circular in shape. In other embodiments, the main chamber 130 may be hollow, but non-circular in shape, such as an oval or rectangular shape, for example. In the illustrated embodiment, the first sub-chamber 115 and second sub-chamber 120 are hollow and circular in shape. In other embodiments, the sub-chambers may be hollow, but non-circular in shape, such as an oval or rectangular shape, for example. Additionally, in another embodiment the first sub-chamber 115 may be circular, whereas the second sub-chamber 120 is non-circular, or vice versa.

The tubular structure 135, the sub-chamber 115, the sub-chamber 120, and the main chamber 130 may be made of aluminum, either with cladding or without cladding. The tubular structure 135, the sub-chamber 115, the sub-chamber 120, and the main chamber 130 may also be made of stainless steel, copper, or other ferrous or non-ferrous material. The tubular structure 135, the sub-chamber 115, the sub-chamber 120, and the main chamber 130 may also be a plastic material or other composite materials. Likewise, the medium directing insert 140 may also be made of aluminum, either with cladding or without cladding. The medium directing insert 140 may also be made of stainless steel, copper or other ferrous or non-ferrous materials. The medium directing insert 140 may also be a plastic material or other composite materials. Also, an embodiment of the present invention allows for the tubular structure 135 and the main chamber 130 to be made of materials different from each other. Additionally, a gasket material may be used to seal between various components utilized to form the heat exchanger unit 251, such as the tubular structure 135, the main chamber 130, the sub-chamber 115, the sub-chamber 120, and the medium directing insert 140.

Structural rigidity is provided by having the medium directing insert being bonded to the first sub-chamber and the second sub-chamber of the chamber assembly. This lends use of the heat exchanger in applications requiring high internal or external pressure environments. Structural rigidity may be provided by utilizing cladded material in combination with a brazing technology, thereby bonding all components together to form a unitary unit. Additionally, welding or soldering of individual components is used in certain applications. In some application, the medium directing insert may be bonded to the sub-chambers by an adhesive.

The chamber assemblies may be formed from multiple components utilizing stamping processes, or may be formed from a single planar material utilizing stamping, casting, machining, cold forging, roll forming, hydroforming, or combination of various fabricating technologies known in the art. Heat exchanging characteristics may be enhanced by adding additional plate materials on the surface of the tube section or on one or more surfaces of the chamber assemblies. Adding additional plate materials on the surface increases the overall surface area of the heat exchanger, and the performance of the heat exchanger may be enhanced by having more surface area to dissipate heat away from the heat exchanger. The additional plate material may comprise of substantially thinner material in comparison to the material used for the chamber assemblies, further enhancing the heat transfer performance of a heat exchanger in some applications.

The chamber assemblies for a heat exchanger are provided, for example, for a condenser, evaporator, radiator, etc. The heat exchanger may also be a heater core, intercooler, or an oil cooler for an automotive application (e.g., steering, transmission, engine, etc.) as well as for non-automotive applications.

The chamber assembly size may vary from one chamber assembly to the next. Each chamber assembly may disperse heat exchanging medium throughout the chamber, which further enhances the heat exchanging capabilities of the present invention. The medium directing insert may also mix the heat exchanging medium. The inner surface of the chamber assembly may feature indentations to increase the surface area. The medium directing insert may also feature indentations. The indentations featured on the interior or the exterior of the chamber assemblies may also be put in place to alter the flow pattern or the flow speed of the heat exchange medium flowing in the chamber or on the outside of the chamber assemblies. The chamber assembly may have other surface features such as, but not limited to, indentations, louvers, dimples, as well as other extended surface features to alter the fluid flow characteristics within or outside the chamber assembly.

Many modifications and variations of the present invention are possible in light of the above teachings. Therefore, within the scope of the appended claims, the present invention may be practiced other than as specifically described.

What is claimed is:

1. A heat exchanger having a chamber assembly, the chamber assembly comprising:

a main chamber;

first and second sub-chambers; and a medium directing insert, wherein the main chamber is formed by a lateral wall joined between spaced apart first and second planar walls, the first sub-chamber is formed by a planar wall and a lateral wall which joins the planar wall of the first sub-chamber to the first planar wall of the main chamber, the planar wall of the first sub-chamber having an inlet formed therein, the second sub-chamber is formed by a planar wall and a lateral wall which joins the planar wall of the second sub-chamber, the planar wall of the second sub-chamber having an outlet formed therein, the medium directing insert has first and second lateral walls with first and second channels disposed therebetween, the first channel having a first angled surface facing the inlet and the second channel having a second angled surface facing the outlet, and each of the first and second lateral walls on a first end of the medium directing insert has a contour to fit under and engage with the lateral wall of the first sub-chamber and on a second end of the medium directing insert has a contour to fit under and engage with the lateral wall of the second sub-chamber, at least one of the lateral walls of the medium directing member on the first end being bonded to the lateral wall of the first sub-chamber, and at least one of the lateral walls of the medium directing member on the second end being bonded to the lateral wall of the second sub-chamber.

2. The heat exchanger of claim 1, wherein each of the lateral walls of the medium directing insert on the first end is bonded to the lateral wall of the first sub-chamber, and each of the lateral walls of the medium directing insert on the second end is bonded to the lateral wall of the second sub-chamber.

3. The heat exchanger of claim 1, wherein an edge on one of the lateral walls on the first end of the medium directing insert is bonded to the planar wall of the first sub-chamber, and an edge on one of the lateral walls on the second end of the medium directing insert is bonded to the planar wall of the second sub-chamber.

4. The heat exchanger of claim 2, wherein each edge of the lateral walls on the first end of the medium directing insert is bonded to the planar wall of the first-chamber, and each edge of the lateral walls on the second end of the medium directing insert is bonded to the planar wall of the second sub-chamber.

5. The heat exchanger of the claim 4, wherein the contour of the lateral walls of each of the first and second sub-chambers is circular, and the contour of each of the first and second lateral walls of the medium directing insert on each of the first and second ends is a partial semi-circle.

6. The heat exchanger of claim 5, wherein the first angled surface of the first channel and the second angled surface of the second channel are opposite sides of a same planar portion of the medium directing insert.

7. The heat exchanger of claim 6, wherein at least one of the first and second channels has as its lateral walls third and fourth lateral walls which are respectively spaced inwardly of the first and second lateral walls of the medium directing insert.

8. The heat exchanger of claim 5 further including a plurality of chamber assemblies and a plurality of tubular structures with one end of a respective tubular structure being coupled to an outlet of a first chamber assembly and the other end of the respective tubular structure being coupled to an inlet of a second chamber assembly.

9. The heat exchanger of claim 8, wherein the plurality of chamber assemblies and tubular structures are coupled between first and second mainfolds.

10. The heat exchanger of claim 4, wherein each of the lateral walls of the medium directing insert is bonded to each of the lateral and planar walls of each of the first and second sub-chambers by one of or more of brazing, welding and soldering.

11. A heat exchanger having a chamber assembly, the chamber assembly comprising:

a main chamber;

first and second sub-chambers; and a medium directing insert, wherein the main chamber is formed by a lateral wall joined between spaced apart first and second planar walls, the first sub-chamber is formed by a planar wall and a lateral wall which joins the planar wall of the first sub-chamber to the first planar wall of the main chamber, the planar wall of the first sub-chamber having an inlet formed therein, the second sub-chamber is formed by a planar wall and a lateral wall which joins the planar wall of the second sub-chamber, the planar wall of the second sub-chamber having an outlet formed therein, the medium directing insert has first and second lateral walls with first and second channels disposed therebetween, the first channel having a first angled surface facing the inlet and the second channel having a second angled surface facing the outlet, each of the first and second lateral walls on a first end of the medium directing insert has a contour to fit under and engage with the lateral wall of the first sub-chamber and on a second end of the medium directing insert has a contour to fit under and engage with the lateral wall of the second sub-chamber, at least one of the lateral walls of the medium directing member on the first end being bonded to the lateral wall of the first sub-chamber, and at least one of the lateral walls of the medium directing member on the second end being bonded to the lateral wall of the second sub-chamber, a first chamber channel is formed by the first lateral wall of the medium directing insert and the lateral and first and second planar walls of the main chamber, a second chamber channel is formed by the second lateral wall of the medium directing insert and the lateral and first and second planar walls of the main chamber, and each of the first and second chamber channels is in fluid communication with both the inlet and outlet.

12. The heat exchanger of claim 11, wherein each of the lateral walls of the medium directing insert on the first end is bonded to the lateral wall of the first sub-chamber, and each of the lateral walls of the medium directing insert on the second end is bonded to the lateral wall of the second sub-chamber.

13. The heat exchanger of claim 11, wherein an edge on one of the lateral walls on the first end of the medium directing insert is bonded to the planar wall of the first sub-chamber, and an edge on one of the lateral walls on the second end of the medium directing insert is bonded to the planar wall of the second sub-chamber.

14. The heat exchanger of claim 12, wherein each edge of the lateral walls on the first end of the medium directing insert is bonded to the planar wall of the first-chamber, and each edge of the lateral walls on the second end of the medium directing insert is bonded to the planar wall of the second sub-chamber.

15. The heat exchanger of the claim 14, wherein the contour of the laterals of each of the first and second sub-chambers is circular, the contour of each of the first and second lateral walls of the medium directing insert on each of the first and second ends is a partial semi-circle, and each of the first and second chamber channels has a flow path of a partial semi-circle.

16. The heat exchanger of claim 15, wherein the first angled surface of the first channel and the second angled surface of the second channel are opposite sides of a same planar portion of the medium directing insert.

17. The heat exchanger of claim 16, wherein at least one of the first and second channels has as its lateral walls third and fourth lateral walls which are respectively spaced inwardly of the first and second lateral walls of the medium directing insert.

18. The heat exchanger of claim 15 further including a plurality of chamber assemblies and a plurality of tubular structures with one end of a respective tubular structure being coupled to an outlet of a first chamber assembly and the other end of the respective tubular structure being coupled to an inlet of a second chamber assembly.

19. The heat exchanger of claim 18, wherein the plurality of chamber assemblies and tubular structures are coupled between first and second mainfolds.

20. The heat exchanger of claim 14, wherein each of the lateral walls of the medium directing insert is bonded to each of the lateral and planar walls of each of the first and second sub-chambers by one of or more of brazing, welding and soldering.

* * * * *